United States Patent [19]

Marple

[11] 4,179,244

[45] Dec. 18, 1979

[54] ROTARY LOW PRESSURE AIR DISPLACEMENT PUMP

[75] Inventor: Elwood Marple, Pinellas Park, Fla.

[73] Assignee: Hargraves Aerobic Systems, Inc., Tampa, Fla.

[21] Appl. No.: 802,131

[22] Filed: May 31, 1977

[51] Int. Cl.[2] ..... F04B 1/04; F04B 27/04

[52] U.S. Cl. ..... 417/273; 92/37; 92/64; 417/473

[58] Field of Search ..... 417/273, 473; 92/37, 92/39, 64; 91/481, 492

[56] References Cited

U.S. PATENT DOCUMENTS

| | | | |
|---|---|---|---|
| 4,533 | 5/1846 | Darling | 417/273 |
| 157,406 | 12/1874 | Leas | 417/473 X |
| 225,931 | 3/1880 | Hyams | 92/37 |
| 862,867 | 8/1907 | Eggleston | 417/390 |
| 1,320,792 | 11/1919 | Noguera et al. | 417/273 |
| 2,307,374 | 1/1943 | Johnston | 417/273 |
| 2,364,111 | 12/1944 | Tucker | 417/273 X |
| 2,553,247 | 5/1951 | Fowler | 417/473 X |
| 3,019,738 | 2/1962 | Zubaty | 417/273 X |
| 3,021,995 | 2/1962 | Neubauer | 417/273 X |
| 3,473,347 | 10/1969 | Andrews et al. | 417/473 X |
| 3,736,074 | 5/1973 | Kilbane et al. | 417/313 X |
| 3,789,954 | 2/1974 | Raleigh | 417/312 X |
| 3,799,703 | 3/1974 | Paine et al. | 417/312 |

FOREIGN PATENT DOCUMENTS

| | | | |
|---|---|---|---|
| 301899 | of 1902 | France | 417/473 |
| 12087 | of 1848 | United Kingdom | 417/473 |
| 781635 | 8/1957 | United Kingdom | 417/269 |

*Primary Examiner*—Carlton R. Croyle
*Assistant Examiner*—Edward Look
*Attorney, Agent, or Firm*—Stein & Frijouf

[57] ABSTRACT

A low pressure air displacement pump including one or more cylinders or bellows powered by rotary or reciprocating motivation means. This device employs two or more bellows radially disposed and activated by a singular rotary source of power which imparts a cranking motion to connecting rods affixed to the bellows, which, in turn supply individual conduits with equal or varying amounts of displaced air, in accordance with the particular sizes of the individual bellows.

5 Claims, 5 Drawing Figures

ROTARY LOW PRESSURE AIR DISPLACEMENT PUMP

This invention relates to a pump capable of dispensing varying amounts or volumes of low pressure air through separate conduits in terms of cubic feet per minute, said pump deriving power from a singular rotary motive source. This can be accomplished in several ways, not the least of which could be a single cylinder or pump supplying compressed air to a holding tank, which in turn is manifolded to supply a multiplicity of conduits a given amount of regulated air pressure or cubic feet per minute delivered at the termini of said conduits; or, said conduits may be pressure regulated individually at any point leaving the manifold to supply varying amounts of cubic feet per minute of air. Another way of accomplishing the end purpose of varying amounts (cubic feet per minute of air) through a multiplicity of conduits could be the employment of separate pumps for each conduit. Indeed, prior to the invention of this particular device, individual vibrator actuated bellows-type aquarium aerators packaged in a single container served this purpose. However, this arrangement resulted in frequent adjustment and readjustment of the individual vibrator mechanisms; heat generation and excessive power consumption, to say nothing of the intensified noise generated by the compounded vibrators. In the case of the former approach, the cost and complications of combining a holding tank, manifold, individual pressure regulators, plus the total lack of sub-miniature regulators, precluded even the consideration of such an approach.

Hence, this low-cost, simply manufacturable, compact device of the present disclosure was conceived. The use for which the present invention has been designed is primarily in conjunction with aerobic self-contained toilets; however, its application to numerous aquaria and other devices requiring low air pressure is truly unlimited. Most of the components are readily available, and those that are not are easily and cheaply fabricated by stampings and thermal vacuum-forming. The source of rotary power is optional, furthermore, it is portable.

Accordingly, it is an object of this invention to provide a novel structure of a low pressure air displacement pump which is uncomplicated and economical to manufacture.

It is a further object of this invention to provide a novel compact pump that is silent of operation with low power consumption and versatility of end uses.

It is a further object of this invention to provide versatility of end uses in conjunction with compactness in structure.

It is a further object of this invention to provide compactness, portability, efficient and dependable, with versatility of end uses in conjunction with low power consumption.

Other objects and advantages of the invention will become apparent in the detailed description of the low powered eccentrically activated rotary pump as follows:

Referring now to the drawings in which.

Figure 1:
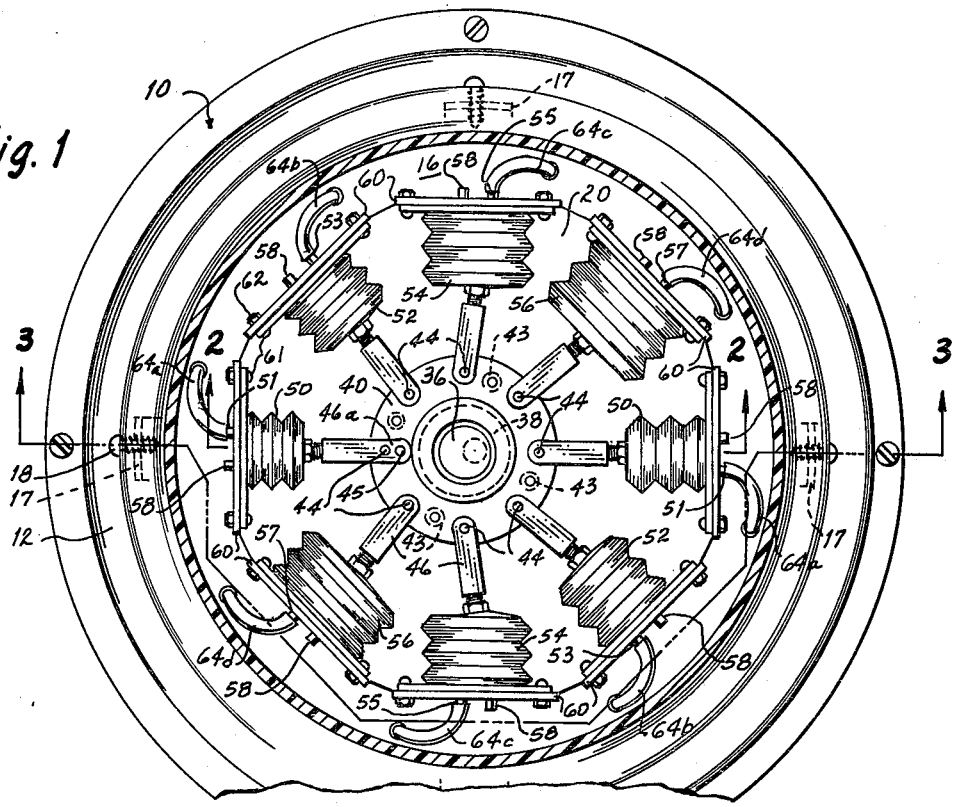
FIG. 1 is a top planar view of the radial bellows arrangement, said view taken along the lines 1—1 of FIG. 3.
Figure 2:
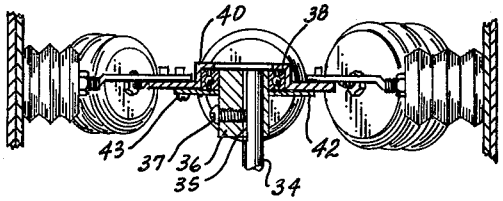
FIG. 2 is a partial section through the bellows arrangement taken along the lines 2—2 of FIG. 1.
Figure 3:
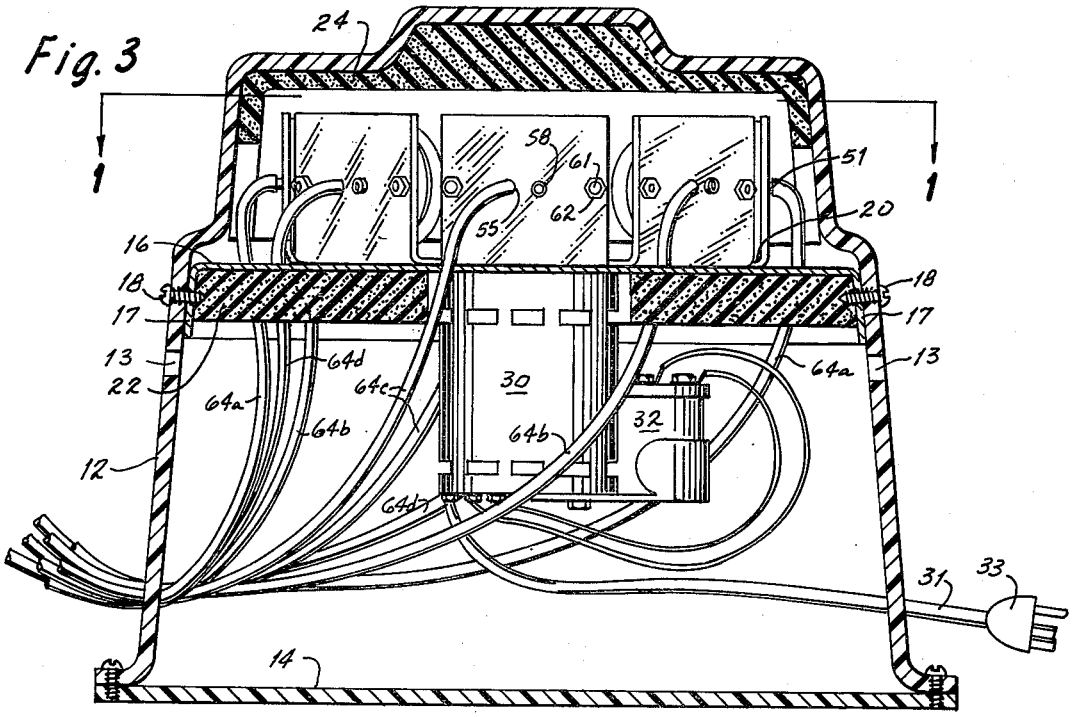
FIG. 3 is a partial cross-sectional and partially elevational view through the entire device taken along the lines 3—3 of FIG. 1.

Referring now to the drawings in general in which like numerals depict like parts and specifically to FIGS. 1, 2 and 3, the overall pumping device is indicated by the numeral 10 (with arrow), consisting of a ventilated enclosure shell 12 having ventilating holes 13 therein (FIG. 3), a bottom closure plate 14, motor and bellows support plate 16 with flanges 17 and mounting screws 18, bellows mounting plate 20 and sound insulating material (such as foam rubber, styrofoam or the like) 22, and similarly, insulating material 24, cemented or otherwise affixed to the undersides of the plate 16 and shell 12, respectively.

FIG. 3 clearly shows a motor 30 with a starting capacitor 32 mounted in a perpendicular position to the support plate 16. Attached to the upwardly protruding motor shaft 34 is an eccentrically bored busing or collet 36 (FIG. 2) which is secured to a flat 35 on the shaft 34 by a set-screw 37. The eccentric busing 36 is press-fit concentrically into a ball-bearing assembly 38, which, in turn, is concentrically press-fit into the shouldered connecting rod plate 40. The three components 36, 38 and 40 are further secured together by means of a flat, washer-like closure plate 42 fastened to the underside of the connecting rod plate 40 by means of four screws 43 (see FIG. 1). Emanating upwardly from the plate 40 are weight studs 44 (FIG. 1) which act as wrist pins for the connecting rods 46 of the various bellows 50, 52, 54 and 56. There is a ninth stud 45 radially aligned (inwardly) with one of the eight studs 44 which engages the extended connecting rod **46*a* for the purpose of stabilizing the plate 40 which would wobble erratically otherwise and diminish the efficiency of the cranking motion imparted to the plate 40 by the eccentric bushing 36 (FIG. 1). The outward termini of the radially disposed connecting rods 46 are attached to the free ends of each of the bellows 50, 52, 54 and 56. The valved ends of each of the bellows are mounted radially to the upturned flanges 60 of the mounting plate 20 by means of bolts and nuts 61 and 62. The intake apertures 58 and exhaust apertures 51, 53, 55 and 57 protrude through the flanges 60 and the exhaust apertures have flexible air hoses 64*a*, 64*b*, 64*c* and 64*d*** slip-fitted thereto.

It should be noted that there are pairs of four different sized bellows 50, 52, 54 and 56 in this exemplary arrangement; however, it should be understood that any number of variously sized bellows can and will be used as required, as well as, indeed, identically sized bellows when required. The versatility of the amounts of air moved by the invention is its very essence. Varying the speed of the motor 30 likewise affects the volumes of air displaced by the device.

Figure 4:
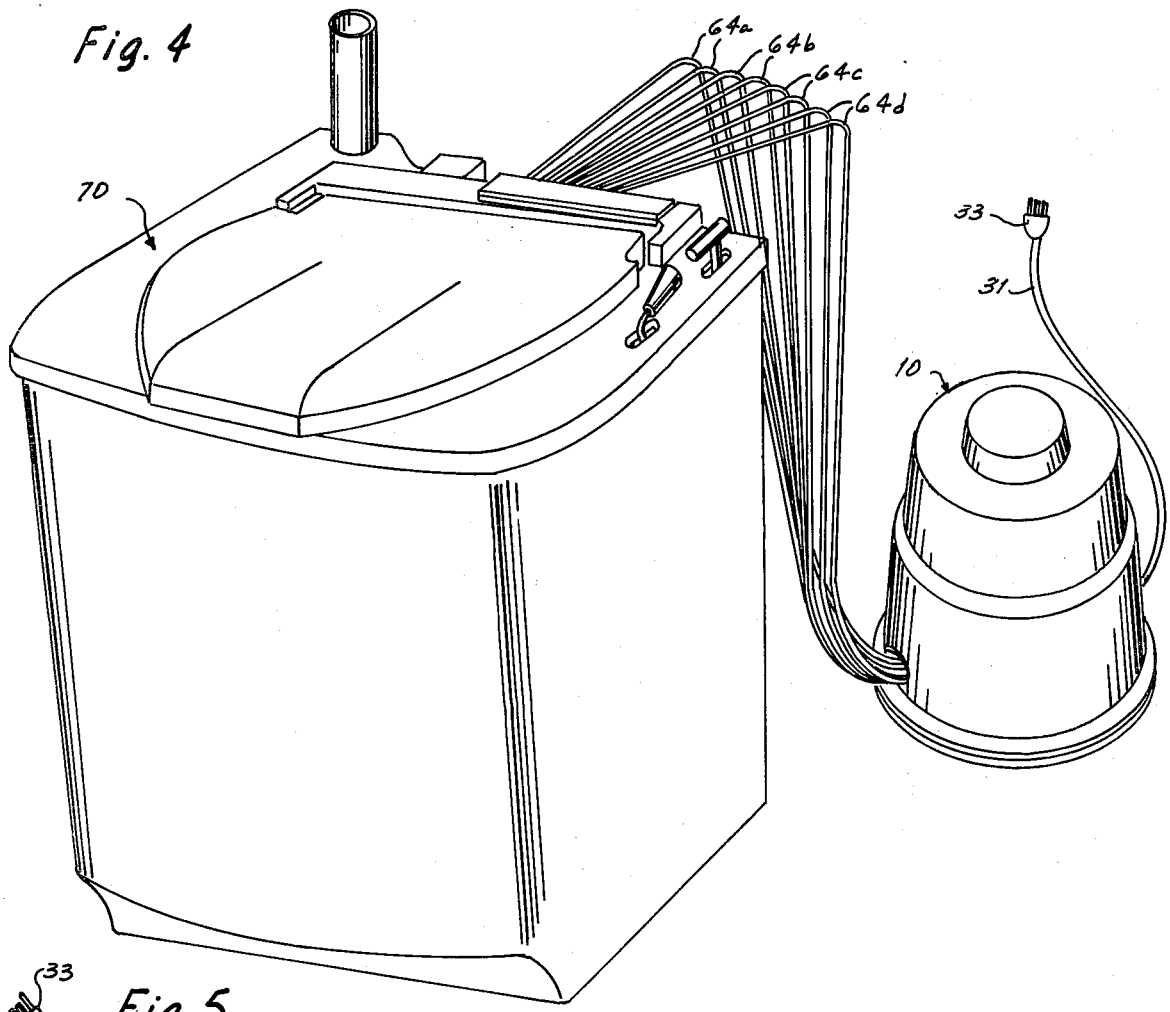
FIG. 4 is a perspective view of a typical arrangement of the aerator pump device together with a self-contained aerobic toilet.

FIG. 4, as previously stated, depicts the invention portrayed in conjunction with a portable, self-contained aerobic toilet, the latter such as is covered in U.S. Pat. No. 3,780,997 and others. The toilet is identified by the numeral 70 (with arrow), the invention 10, the flexible air hoses 64 and the electrical power line 31 with grounded plug 33.

Figure 5:
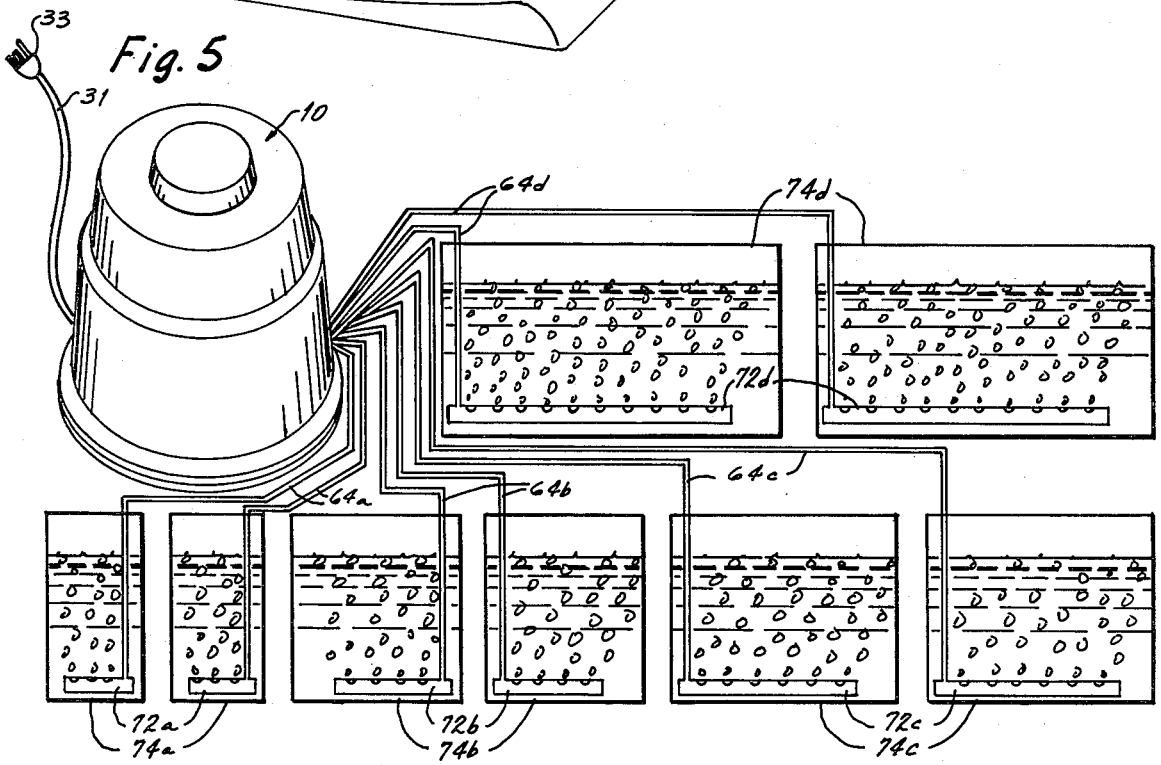
FIG. 5 is a diagrammic view of a typical arrangement of the aerator device with a series of various sizes of tanks or compartments to be aerated.

FIG. 5 shows the invention 10, power line 31 and plug 33, and air hoses 64*a*, 64*b*, 64*c* and 64*d* expelling their various volumes of air through perforated aerators 72*a*, 72*b*, 72*c* and 72*d* into tanks or compartments 74*a*, 74*b*, 74*c* and 74*d*.

Thus it can be readily seen that this invention, with its utter simplicity of design and construction, most admirably performs the function of delivering various or equal volumes of air in terms of cubic feet per minute to whatever devices that may require aeration. The power depicted herein has been electromotive; however, it is reasonable and anticipatory to assume that any rotary motion could be imparted to the radially disposed bellows, such as by internal combustion engines, steam engines, windmill, watermill or other power, particularly in the application toward a portable or remotely located aerobic toilet of even aquaria.

Thus, it is apparent that the following advantages of the hereinabove described low pressure rotary pump are economical to manufacture, silent of operation, simple to maintain and operate, low in power consumption, versatile in end use, compact, portable, efficient and dependable.

What I claim is:

1. A multiple pump assembly for supplying fluid under different fluid pressure outputs to a plurality of utility devices, comprising in combination:

a housing member for enclosing the pump assembly;

a support mounted in said housing member;

a plurality of pumps circumferentially mounted on said support about a central region of said support;

each of said pumps comprising an inlet valve communicating directly with an ambient source of the fluid and an outlet valve communicating with one of the plurality of utility devices;

each of said pumps further comprising a bellow member communicating with said respective inlet and outlet valves;

a shaft rotatably mounted in proximity to said central region of said support;

eccentric means secured to said shaft;

a plurality of connecting rods interconnecting said eccentric means to said plurality of bellow members for providing uniform reciprocal displacement of said plurality of bellow members upon rotation of said shaft; and means establishing said plurality of bellow members to be of different bellow cross-sectional areas to provide different fluid pressure outputs to the plurality of utility devices upon rotation of said shaft.

2. A multiple pump as set forth in claim 1 wherein each of said outlet valves is connected to the respective utility devices by a flexible conduit.

3. A multiple pump as set forth in claim 2 including a sound insulating material secured relative to said housing member for providing a reduced operational noise level.

4. A multiple pump as set forth in claim 3, including an electric motor connected for rotating said shaft.

5. A multiple pump as set forth in claim 4, wherein said eccentric means comprises a plate eccentrically mounted on said shaft.

* * * * *